US009331380B2

(12) United States Patent
Hsu et al.

(10) Patent No.: US 9,331,380 B2
(45) Date of Patent: May 3, 2016

(54) TUNABLE ANTENNA AND WIRELESS COMMUNICATION DEVICE EMPLOYING SAME

(71) Applicant: Chiun Mai Communication Systems, Inc., New Taipei (TW)

(72) Inventors: Cho-Kang Hsu, New Taipei (TW); Tze-Hsuan Chang, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 237 days.

(21) Appl. No.: 14/068,240

(22) Filed: Oct. 31, 2013

(65) Prior Publication Data

US 2014/0313084 A1 Oct. 23, 2014

(30) Foreign Application Priority Data

Apr. 23, 2013 (TW) ..... 102114282 A

(51) Int. Cl.

| | |
|---|---|
| ***H01Q 1/38*** | (2006.01) |
| ***H01Q 1/24*** | (2006.01) |
| ***H01Q 5/371*** | (2015.01) |
| ***H01Q 5/378*** | (2015.01) |

(52) U.S. Cl.
CPC ..... *H01Q 1/243* (2013.01); *H01Q 5/371* (2015.01); *H01Q 5/378* (2015.01)

(58) Field of Classification Search
CPC ..... H01Q 1/243; H01Q 5/371; H01Q 5/378
USPC ..... 343/700 MS, 702
See application file for complete search history.

(56) References Cited

U.S. PATENT DOCUMENTS

| | | | | |
|---|---|---|---|---|
| 6,329,959 | B1 * | 12/2001 | Varadan | H01Q 1/364 343/700 MS |
| 2010/0123631 | A1 * | 5/2010 | Chang | H01Q 1/243 343/700 MS |
| 2012/0242555 | A1 * | 9/2012 | Hsieh | H01Q 1/243 343/833 |

* cited by examiner

*Primary Examiner* — Dieu H Duong
(74) *Attorney, Agent, or Firm* — Novak Druce Connolly Bove + Quigg LLP

(57) ABSTRACT

A tunable antenna including a dielectric substrate, a main antenna, and a resonating antenna is disclosed. The dielectric substrate is made of dielectric constant-tunable material. The main antenna is positioned on the dielectric substrate, the main antenna includes a feeding arm and a first grounding arm. The main antenna generates a low-frequency mode and at least one high-frequency mode. The resonating antenna is positioned on the dielectric substrate. The resonating antenna resonates with the main antenna to generate another high-frequency mode. The central frequencies of the low-frequency mode and the high-frequency modes of the tunable antenna are adjusted by adjusting a dielectric constant of the dielectric substrate.

16 Claims, 2 Drawing Sheets

TUNABLE ANTENNA AND WIRELESS COMMUNICATION DEVICE EMPLOYING SAME

BACKGROUND

1. Technical Field

The exemplary disclosure generally relates to antennas, and particularly to a tunable antenna and wireless communication device employing same.

2. Description of Related Art

With improvements in the integration of wireless communication systems, broadband antennas have become increasingly important. In order to permit a wireless communication device to utilize various frequency bandwidths, antennas having wider bandwidth have become a significant technology. Typically a broadband antenna has a wide bandwidth only at high frequency band or low frequency band. It is desirable to provide a broadband band which not only has a wide high frequency bandwidth, but also has a wide low frequency bandwidth.

Therefore, there is room for improvement within the art.

BRIEF DESCRIPTION OF THE DRAWINGS

Many aspects of the embodiments can be better understood with reference to the drawings. The components in the drawings are not necessarily drawn to scale, the emphasis instead being placed upon clearly illustrating the principles of the disclosure.

DETAILED DESCRIPTION

Figure 1:
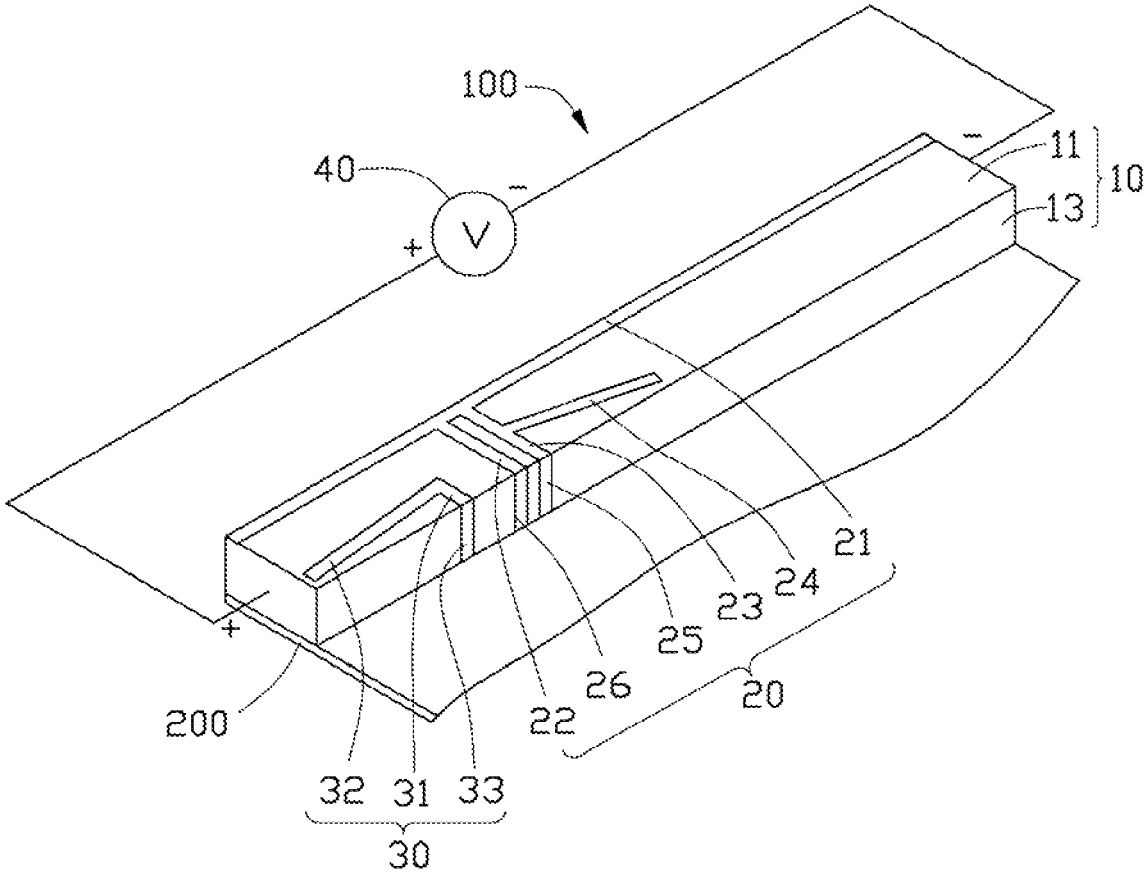
FIG. 1 is a schematic view of a tunable antenna, according to an exemplary embodiment.

FIG. 1 is an exemplary embodiment of a tunable antenna 100. The tunable antenna 100 can be used in a wireless communication device, such as a mobile phone or a tablet computer for example. The tunable antenna 100 includes a dielectric substrate 10, a main antenna 20, a resonating antenna 30, and a voltage generator 40. The dielectric substrate 10 is positioned on a printed circuit board (PCB) 200 of the wireless communication device. The main antenna 20 and the resonating antenna 30 are positioned on the dielectric substrate 10. The voltage generator 40 is preferable a power supply of the PCB 200.

The dielectric substrate 10 includes a first surface 11 and a second surface 13 substantially perpendicular to the first surface 11. When the dielectric substrate 10 is positioned on the PCB 200, the first surface 11 is parallel with and spaced apart from the PCB 200, the second surface 13 is connected between the first surface 11 and the PCB 200. The dielectric substrate 10 is made of dielectric constant-tunable materials, such as ferroelectric material, ceramic material, or resin-ceramic composite material. A first end of the dielectric substrate 10 is electronically connected to a positive pole of the voltage generator 40, a second end opposite to the first end of the dielectric substrate 10 is electronically connected to a negative pole of the voltage generator 40. A dielectric constant of the dielectric substrate 10 is tunable with the change of an output voltage of the voltage generator 40. In the exemplary embodiment, the dielectric constant of the dielectric substrate 10 is tunable within a range of 3~30.

The main antenna 20 includes a first radiation arm 21, a second radiation arm 22, a third radiation arm 23, a fourth radiation arm 24, a feeding arm 25, and a grounding arm 26. The first radiation arm 21 is substantially a rectangular sheet, and is positioned on the first surface 11 of the dielectric substrate 10. The second and third radiation arms 22 and 23 extend from one side of the first radiation arm 21. The second radiation arm 22 is parallel with and spaced apart from the third radiation arm 23. The fourth radiation arm 24 extends from substantially a middle portion of a side of the third radiation arm 23 away from the second arm 22. A distal end of the fourth radiation arm 24 is slanted away from the first radiation arm 21, in other words, the fourth radiation arm 24 and an end of the third radiation arm 23 connect to the first radiation arm 24 cooperatively form an obtuse angle. The second, third and fourth radiation arms 22, 23, 24 are coplanar with the first radiation arm 21. That is, all of the first, second, third and fourth radiation arms 21-24 are positioned on the first surface 11 of the dielectric substrate 10.

The feeding arm 25 substantially perpendicularly extends from a distal end of the third radiation arm 23. The grounding arm 26 substantially perpendicularly extends from a distal end of the second radiation arm 22. The feeding arm 25 is parallel with and spaced apart from the feeding arm 26. The feeding arm 25 and the grounding arm 26 are positioned on the second surface 13, that is, the feeding arm 25 and the grounding arm 26 are positioned in a plane perpendicular to the plane in which the second and third radiation arms 22 and 23 are positioned. A distal end of the feeding arm 25 is electronically connected to the PCB 200 to feeding current signals. A distal end of the grounding arm 26 is grounded via the PCB 200.

The resonating antenna 30 is positioned at a side of the second radiation arm 22 away from the third radiation arm 23. The resonating antenna 30 includes a second resonating arm 32, a grounding arm 33, and a first resonating arm 31 connected between the second resonating arm 32 and the grounding arm 33. The first and second resonating arms 31, 32 are positioned on the first surface 11 of the dielectric substrate 10. The first resonating arm 31 is parallel with the second radiation arm 22, and a length of the first resonating arm 31 is shorter than a length of the second radiation arm 22. The second resonating arm 32 is positioned at one side of the first resonating arm 31 away from the second radiation arm 22, an angle between the first resonating arm 31 and second resonating arms 32 is slightly less than ninety degrees. The grounding arm 33 is substantially perpendicular to the first resonating arm 31. The grounding arm 33 is positioned on the second surface 13 of the dielectric substrate 10, and is parallel with and spaced apart from the grounding arm 26. The grounding arm 23 is grounded via the PCB 200.

In use, current signals are fed to the feeding arm 25, the main antenna 20 generates a low-frequency mode, a first high-frequency mode, and a second high-frequency mode; simultaneously, the resonating antenna 30 resonates with the main antenna 20, to generate a third high-frequency mode, such that a high frequency bandwidth of the tunable antenna 100 has been broadened. In addition, the voltage generator 40 can generate different output voltages to adjust the dielectric constant of the dielectric substrate 10, central frequencies of the low-frequency mode and the three high-frequency modes are regulated by the adjustment of the dielectric constant of the dielectric substrate 10, such that the low frequency bandwidth and the high frequency bandwidth of the tunable antenna can be further broadened.

Figure 2:
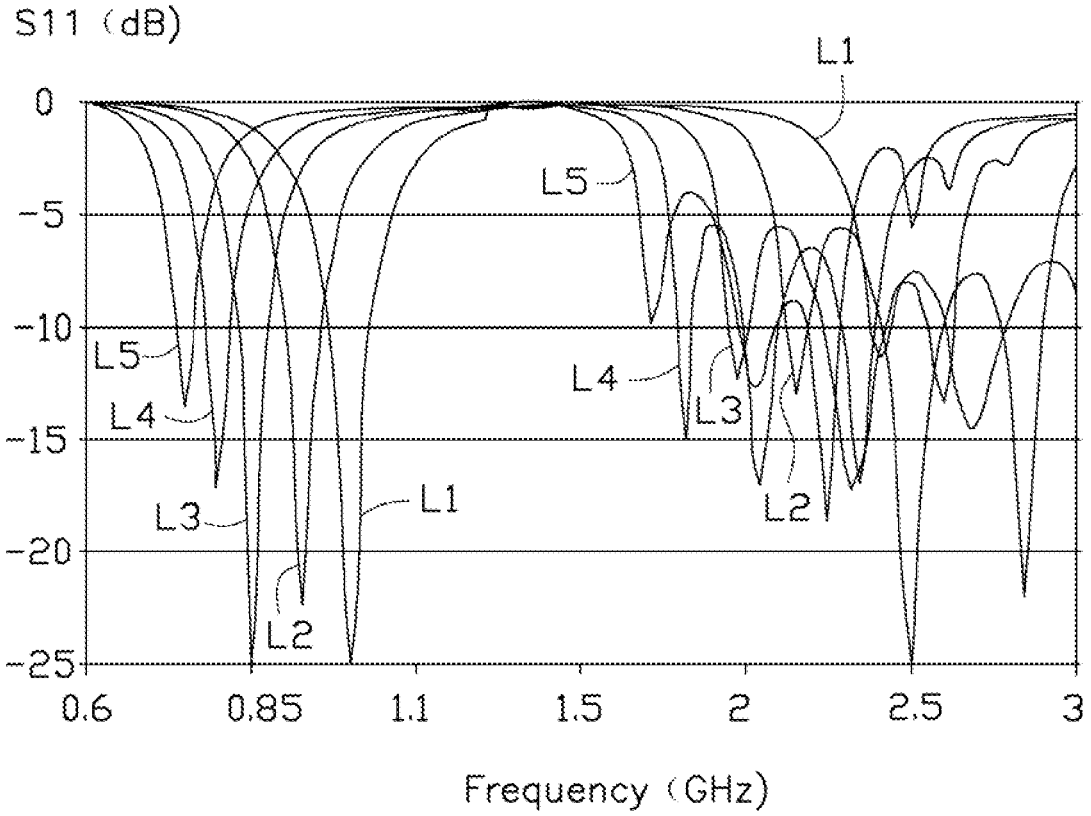
FIG. 2 is a diagram showing return loss (RL) measurement of the tunable antenna shown in FIG. 1.

FIG. 2 is a diagram showing return loss (RL) measurement of the tunable antenna shown in FIG. 1. Curves L1-L5 in FIG. 2 respectively present S11 curves (return losses) of the tunable antenna when the dielectric substrate 10 has a dielectric constant K of 6, 8, 10, 12, and 14. It can be seen from FIG. 2 that when the dielectric constant K of the dielectric substrate 10 is increased, the central frequency of each mode of the tunable antenna 100 is decreased. Alternatively, when the dielectric constant K of the dielectric substrate 10 is decreased, the central frequency of each mode of the tunable antenna 100 is increased. Thus, the central frequency of each mode of the tunable antenna 100 can be adjusted by adjusting the dielectric constant of the dielectric substrate 10, and the frequency bandwidth of the tunable antenna 100 can be broadened with the adjustment of the central frequency of each mode of the tunable antenna 100. In the exemplary embodiment, the tunable antenna 100 is capable of transmitting wireless signals with frequencies from about 700 MHz to 2500 MHz. Accordingly, the wireless communication device employing the tunable antenna 100 can be used in common wireless communication systems, such as LTE700/GSM850/GSM900/DCS1800/PCS1900/UMTS2100/LTE2300/LTE250, with acceptable communication quality.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. A tunable antenna, comprising:

a dielectric substrate made of dielectric constant-tunable material;

a main antenna positioned on the dielectric substrate, the main antenna comprising a feeding arm and a first grounding arm, the feeding arm feeding current signals, the main antenna generating a low-frequency mode and at least one high-frequency mode; and a resonating antenna positioned on the dielectric substrate, the resonating antenna comprising a second grounding arm, the resonating antenna resonating with the main antenna to generate another high-frequency mode;

wherein central frequencies of the low-frequency mode and the high-frequency modes of the tunable antenna are adjusted by adjusting a dielectric constant of the dielectric substrate;

wherein the main antenna further comprises a first radiation arm, a second radiation arm, a third radiation arm and a fourth radiation arm, the first and second radiation arms substantially perpendicularly extend from one side of the first radiation arm; the feeding arm substantially perpendicularly extends from a distal end of the third radiation arm; the grounding arm substantially perpendicularly extends from a distal end of the second radiation arm;

wherein the fourth radiation arm extends from one side of the third radiation arm away from the second radiation arm, the fourth radiation arm is coplanar with the third radiation arm.

2. The tunable antenna of claim 1, further comprising a voltage generator, wherein the voltage generator outputs different output voltages to the dielectric substrate to adjust the dielectric constant of the dielectric substrate.

3. The tunable antenna of claim 1, wherein the dielectric substrate comprises a first surface and a second surface substantially perpendicular to the first surface, the first, second and third radiation arms are positioned on the first surface, the feeding arm and the grounding arm are positioned on the second surface.

4. The tunable antenna of claim 3, wherein a distal end of the fourth radiation arm is slanted away from the first radiation arm.

5. The tunable antenna of claim 1, wherein the resonating antenna further comprises a second resonating arm and a first resonating arm connected between the second resonating arm and the second grounding arm; the first resonating arm is parallel with the second radiation arm; the second resonating arm is positioned at one side of the first resonating arm away from the second radiation arm.

6. The tunable antenna of claim 5, wherein an angle between the second resonating arm and the first resonating arm is slightly less than 90 degrees.

7. The tunable antenna of claim 6, wherein the first and second resonating arms are coplanar with the second radiation arm; the second grounding arm substantially perpendicularly extends from a distal end of the first resonating arm, the second grounding arm is parallel with the first grounding arm.

8. The tunable antenna of claim 1, wherein the dielectric constant of the dielectric substrate is within a range of 3~30.

9. A wireless communication device, comprising:

a printed circuit board (PCB) configured for outputting current signals;

a tunable antenna comprising:

a dielectric substrate made of dielectric constant-tunable material;

a main antenna positioned on the dielectric substrate, the main antenna comprising a feeding arm and a first grounding arm grounded via the PCB, the feeding arm electronically connected to the PCB to feeding the current signals, the main antenna generating a low-frequency mode and at least one high-frequency mode; and a resonating antenna positioned on the dielectric substrate, the resonating antenna comprising a second grounding arm grounded via the PCB, the resonating antenna resonating with the main antenna to generate another high-frequency mode;

wherein central frequencies of the low-frequency mode and the high-frequency modes of the tunable antenna are adjusted by adjusting a dielectric constant of the dielectric substrate;

wherein the main antenna further comprises a first radiation arm, a second radiation arm, a third radiation arm and a fourth radiation arm, the first and second radiation arms substantially perpendicularly extend from one side of the first radiation arm; the feeding arm substantially perpendicularly extends from a distal end of the third radiation arm; the grounding arm substantially perpendicularly extends from a distal end of the second radiation arm;

wherein the fourth radiation arm extends from one side of the third radiation arm away from the second radiation arm, the fourth radiation arm is coplanar with the third radiation arm.

10. The wireless communication device of claim 9, further comprising a voltage generator, wherein the voltage generator outputs different output voltages to the dielectric substrate to adjust the dielectric constant of the dielectric substrate.

11. The wireless communication device of claim 9, wherein the dielectric substrate comprises a first surface and a second surface substantially perpendicular to the first surface, the first, second and third radiation arms are positioned on the first surface, the feeding arm and the grounding arm are positioned on the second surface.

12. The wireless communication device of claim 11, wherein a distal end of the fourth radiation arm is slanted away from the first radiation arm.

13. The wireless communication device of claim 9, wherein the resonating antenna further comprises a second resonating arm and a first resonating arm connected between the second resonating arm and the second grounding arm; the first resonating arm is parallel with the second radiation arm; the second resonating arm is positioned at one side of the first resonating arm away from the second radiation arm.

14. The wireless communication device of claim 13, wherein an angle between the second resonating arm and the first resonating arm is slightly less than 90 degrees.

15. The wireless communication device of claim 14, wherein the first and second resonating arms are coplanar with the second radiation arm; the second grounding arm substantially perpendicularly extends from a distal end of the first resonating arm, the second grounding arm is parallel with the first grounding arm.

16. The wireless communication device of claim 9, wherein the dielectric constant of the dielectric substrate is within a range of 3~30.

* * * * *